United States Patent [19]

Sills

[11] 4,357,419

[45] Nov. 2, 1982

[54] COVERING POWER IN FILMS

[75] Inventor: Peter D. Sills, St. Paul, Minn.

[73] Assignee: Minnesota Mining and Manufacturing Company, St. Paul, Minn.

[21] Appl. No.: 250,393

[22] Filed: Apr. 2, 1981

[51] Int. Cl.[3] ..... G03C 1/02; G03C 1/28

[52] U.S. Cl. ..... 430/564; 430/599; 430/607; 430/966; 430/637; 430/638; 430/631

[58] Field of Search ..... 430/564, 599, 600, 631, 430/607, 638, 966, 637

[56] References Cited

U.S. PATENT DOCUMENTS

| | | | |
|---|---|---|---|
| 2,376,005 | 4/1963 | Feddar et al. | 95/7 |
| 2,489,341 | 11/1949 | Waller et al. | 95/7 |
| 2,675,314 | 4/1951 | Vittum | 430/607 |
| 2,904,434 | 9/1959 | Milton | 96/94 |
| 2,960,404 | 11/1960 | Milton et al. | 96/94 |
| 3,042,524 | 7/1962 | Albus et al. | 96/94 |
| 3,085,010 | 4/1963 | Chambers | 430/631 |
| 3,393,072 | 7/1968 | Ohi et al. | 430/607 |
| 3,520,694 | 7/1970 | Nishio et al. | 96/114.4 |
| 3,640,721 | 2/1972 | Ishihara et al. | 96/114.4 |
| 3,650,759 | 3/1972 | Sonoda et al. | 96/107 |
| 3,725,077 | 4/1973 | Kuffner et al. | 430/607 |
| 4,254,210 | 3/1981 | Stappen | 430/966 |

FOREIGN PATENT DOCUMENTS

| | | |
|---|---|---|
| 2020943 | 4/1970 | Fed. Rep. of Germany . |
| 55-38541 | 3/1980 | Japan . |
| 623448 | 5/1949 | United Kingdom . |
| 1013905 | 12/1965 | United Kingdom . |
| 1019693 | 2/1966 | United Kingdom . |
| 1062933 | 3/1967 | United Kingdom . |

*Primary Examiner*—Won H. Louie, Jr.
*Attorney, Agent, or Firm*—Cruzan Alexander; Donald M. Sell; Lorraine R. Sherman

[57] ABSTRACT

A silver-halide/gelatin light-sensitive emulsion containing a saturated cyclic oxime compound, and optionally containing a di- or trimethylol lower alkane compound is disclosed. The light-sensitive emulsion coated on a substrate is particularly useful as a radiographic film.

15 Claims, No Drawings

COVERING POWER IN FILMS

TECHNICAL FIELD

The present invention relates to a silver halide/gelatin light-sensitive emulsion containing a saturated cyclic oxime compound. In another aspect, it relates to a silver halide/gelatin light-sensitive emulsion containing a saturated cyclic oxime compound and a lower alkyl di- or trimethylol compound. The light-sensitive emulsion coated on a substrate is useful in photography, particularly for radiographic films and for black and white films in general.

BACKGROUND ART

In many silver imaging systems, image density is provided by silver itself. In view of the increasing cost of silver, it is important to reduce both the amount of silver in the emulsion and the amount of silver remaining in the image. One measure of the ability of silver within the emulsion to provide image density is referred to as covering power. This, as is well-known in the art, is defined as the maximum optical density obtainable for a given coating weight of silver, or more specifically, $$\frac{D\text{max (in density units)}}{\text{Ag wt. (in g/m}^2\text{)}}.$$

The goal in silver containing imaging systems is to use less silver to produce the desired maximum optical density.

Previous attempts to improve covering power have involved use of certain additives in silver halide emulsions. U.K. Patent Specification No. 1,019,693 teaches the use of starch derivatives for this purpose. U.K. Patent Specification No. 1,013,905 discloses use of a copolymer of acrylic acid and an N-substituted acrylamide to achieve an increase in covering power. Polyvinyl alcohols having molecular weights of 10,000 to 30,000 are disclosed in U.K. Patent Specification No. 1,062,933 to be useful in increasing the covering power of silver halide emulsions having a silver halide grain size predominantly in the range of 0.5–2 microns. A difficulty encountered with many additives aimed at increasing covering power is that they have an adverse effect on the hardness of the emulsion layer, with resultant deterioration in the physical properties of the film.

Increased sensitivity of a silver imaging system can also be related to increased covering power. U.S. Pat. No. 3,650,759 teaches use of 1,2-glycols to achieve improved sensitivity of a photographic silver halide emulsion, without an attendant increase in fog.

Various alcohols and cyclohexanes have been used in the art as gelatin plasticizers to stabilize films against mechanical stress, for example, U.S. Pat. No. 3,042,524 (polyhydric alcohols such as 1,2,4-butanetriol), U.S. Pat. No. 3,520,694 (lower alkyl trimethylols), U.S. Pat. No. 3,640,721 (cyclohexanes), U.S. Pat. No. 2,960,404 (dihydroxy alkanes such as 2,2-dimethyl-1,3-propanediol and 2-methyl-2,4-pentanediol), and U.S. Pat. No. 2,904,434 (ethylene glycolates).

Due to the increasing cost of silver, there remains a need in the art to develop emulsions having superior silver covering power. There also is a need to reduce or prevent the generation of fog during the coating and fast drying of silver halide photographic emulsions.

DISCLOSURE OF THE INVENTION

Briefly, in one aspect of the invention there is provided a silver halide emulsion comprising a silver halide dispersed in a binder and at least one saturated cyclic oxime compound.

In another aspect, there is provided a silver halide emulsion comprising a silver halide dispersed in a binder, at least one saturated cyclic oxime compound, and a di- or trimethylol lower alkane compound.

The addition of between 0.1 and 2.0 gram per mole of silver of a saturated cyclic oxime in a silver halide emulsion results in significant increases in silver covering power without significantly adversely affecting hardening, or in some cases even increasing hardening, of the emulsion. It has been found possible to decrease the amount of silver required in the final coating by as much as 30 percent when saturated cyclic oximes are present therein. In order to reduce or prevent the generation of fog during the coating and fast drying of X-ray emulsions, it has been customary in the art to introduce into the emulsion a hydrophobic polymer in latex form, e.g., polyethylacrylate(PEA) as disclosed in U.S. Pat. No. 2,376,005, immediately prior to the coating operation. It has been found that when this latex is replaced completely with 5 to 50 g/mole of a di- or trimethylol lower alkane compound, equivalent or even much reduced fog levels are achieved, when compared to emulsions containing no hydrophobic polymer or if compared to the standard emulsion containing that polymer. As mentioned above, U.S. Pat. No. 3,520,694 teaches that lower alkyl trimethylol compounds provide a gelatino silver halide emulsion with enhanced resistance to mechanical stress.

Addition of both a saturated cyclic oxime and a di- or trimethylol lower alkane in an X-ray or other photographic emulsion results in an improvement of up to 20 percent in silver covering power. The present invention provides a means for substantially reducing the fog level and significantly improving the silver covering power of silver halide photographic emulsions.

In a further aspect a silver halide/gelatin light-sensitive element is provided comprising a silver halide/gelatin light sensitive emulsion containing at least one saturated cyclic oxime compound, the emulsion being coated upon any substrate such as polyester film, triacetate film, paper, etc.

In a still further aspect, a silver halide/gelatin light-sensitive element is provided comprising a silver halide/gelatin light sensitive emulsion containing at least one saturated cyclic oxime compound and at least one di- or trimethylol lower alkane compound, the emulsion being coated upon a suitable substrate.

DETAILED DESCRIPTION OF THE INVENTION

The present invention provides a silver halide emulsion comprising at least one compound of a class of cyclic oximes, said class being saturated cyclic oxime compounds having the oximido group attached to a ring carbon.

"Cyclic" refers to a carbocyclic saturated or aromatic ring, preferably of 4 to 7 ring carbon atoms, most preferably of 5 to 6 carbon atoms in the ring.

The present invention further provides a silver halide emulsion comprising, in addition to a cyclic oxime, a di- or trimethylol lower alkane compound having the formula

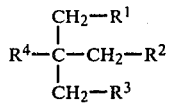

wherein $R^1$, $R^2$, and $R^3$ are selected from H and OH and wherein at least two of $R^1$, $R^2$, and $R^3$ are OH, and $R^4$ is a lower alkyl group of 1 to 5 carbon atoms.

The class of cyclic oximes included in the present invention are saturated ring containing oximes, such as cyclopentanone oximes, cyclohexanone oximes, and cycloheptanone oximes, wherein the oximido group is attached directly to a ring carbon. Included in this class are compounds such as cyclohexanone oxime, 2-methyl cyclohexanone oxime, 3-methylcyclohexanone oxime, 4-methylcyclohexanone oxime, cyclopentanone oxime, and cycloheptanone oxime. In any of the saturated ring containing oximes, the ring carbon atoms can be substituted by alkyl groups of 1 to 5 carbon atoms. The cyclohexanone oximes are the preferred members of the class, with cyclohexanone oxime being most preferred. In all cases the compounds are carbocyclic, having a total of up to 7 carbon atoms in the ring and aliphatic substituents thereon having up to 7 carbon atoms.

Di- and trimethylols useful in reducing the fog level of silver halide light sensitive emulsions include 1,1,1-trimethylols and 1,1-dimethylols such as 2,2-dimethyl-1,3 propanediol (DMPD), and 2-methyl-1,2,3-propanetriol (MPT).

Preparation of the silver halide light sensitive emulsions used in the examples of the present invention generally involved precipitation and ripening steps using 98.0 mole percent silver bromide and 2.0 mole percent silver iodide in the presence of 15 g gelatin per mole of silver halide. The precipitated silver halide was freed of unwanted soluble by-product salts by coagulation and washing using the method disclosed in U.S. Pat. No. 2,489,341 wherein the silver halide and most of the gelatin were coagulated by sodium lauryl sulfate, using an acid coagulation environment. Following the washing step, the emulsion coagulum was redispersed in water together with 67 g of additional gelatin. This redispersed emulsion was treated with conventional sulfur and gold sensitizers and was digested at 55° C. to increase sensitivity, was cooled to 40° C., and was then treated with post sensitization additives and stabilizers, namely tetraazaindines, additional halides, and conventional antifoggants, etc., as required and as is known in the art. The emulsion was coated upon a substrate which may be, for example, polyester film, triacetate film, or paper, to provide a silver coating weight in the range of 5.5 to 7.0 g/m$^2$. Generally, crystals or grains of all known photographic silver halides such as silver chloride, silver bromide, silver chlorobromide, silver bromochloroiodide, and the like may also be used in the practice of the present invention. Conventional additives, such as sensitizing dyes, antifoggants, surfactants, antistatic compounds, stabilizers, coating aids, and the like, as well as conventional treatments, and processing may be used in the practice of the present invention.

The present invention which increases the covering power of silver, thereby requiring less of this costly element to be used, finds utility in photography, particularly for radiographic and other black and white films.

Objects and advantages of this invention are further illustrated by the following examples, but the particular materials and amounts thereof recited in these examples, as well as other conditions and details, should not be construed to unduly limit this invention.

Comparisons of D-max, contrast, and covering power were made relative to the controls within a set of samples. Variant results in absolute values among different sets of samples were due to variations in coating weight, drying conditions, and parent emulsions which normally occur in experimental work.

EXAMPLE 1

An emulsion was prepared as described above. Specified amounts of 2,2-dimethyl-1,3-propanediol (DMPC) were added to three aliquots; two controls were used. In all samples, amounts of compounds used were in grams per mole of silver. Results are shown in TABLE I.

TABLE I

| Sample | PEA[a] | DMPD[b] | D-Min | Speed | Av. Contrast | D-Max* |
|---|---|---|---|---|---|---|
| 1 (control) | 0 | 0 | 0.23 | 2.06 | 3.09 | 3.12 |
| 2 (control) | 25 | 0 | 0.17 | 2.05 | 3.01 | 3.11 |
| 3 | 12.5 | 0 | 0.21 | 1.90 | 3.30 | 3.27 |
| 4 | 0 | 8.50 | 0.24 | 2.00 | 3.20 | 3.55 |
| 5 | 0 | 17.0 | 0.19 | 2.04 | 3.59 | 3.60 |

[a]polyethylacrylate
[b]2,2-dimethyl-1,3-propanediol
*@ 6.0 g Ag/m$^2$

The data of TABLE I show that DMPD was effective in lowering the D-min and raising the D-max of the emulsion, thereby increasing its optical density and averge contrast.

EXAMPLE 2

Emulsion aliquots were prepared using specified amounts of DMPD and cyclohexanone oxime (CHOX); two controls were run.

TABLE II

| Sample | PEA | DMPD | CHOX | D-Min | Relative Speed | Av. Contrast | D-Max* |
|---|---|---|---|---|---|---|---|
| 6 (control) | 0 | 0 | 0 | 0.23 | 2.06 | 3.09 | 3.12 |
| 7 (control) | 25 | 0 | 0 | 0.17 | 2.03 | 2.94 | 3.01 |
| 8 | 25 | 0 | 0.8 | 0.18 | 2.09 | 3.43 | 3.58 |
| 9 | 0 | 0 | 0.8 | 0.24 | 2.09 | 3.42 | 3.82 |
| 10 | 0 | 12.5 | 0.8 | 0.21 | 2.09 | 3.47 | 3.70 |
| 11 | 0 | 25.0 | 0.8 | 0.16 | 2.14 | 3.63 | 4.09 |

*@6.0 g Ag/m$^2$

The data of TABLE II show that improvement in optical density and average contrast of the emulsion resulted when CHOX was used compared to the controls. Using both DMPD and CHOX, good optical densities and high average contrasts were obtained.

EXAMPLE 3

All of the emulsions of TABLE III contained PEA (25 g/mole Ag). No di- or trimethylol compounds were present.

TABLE III

| Sample | Compounds A | B | C | D | E | F | G | H | D-Min | Rel. Speed | Av. Contrast | D-Max* | Covering Power |
|---|---|---|---|---|---|---|---|---|---|---|---|---|---|
| 12 (control) | 0 | 0 | 0 | 0 | 0 | 0 | 0 | 0 | 0.21 | 1.97 | 2.96 | 3.96 | 0.66 |
| 13 | 0.80 | 0 | 0 | 0 | 0 | 0 | 0 | 0 | 0.22 | 1.98 | 3.14 | 4.30 | 0.71 |
| 14 | 0 | 0.20 | 0 | 0 | 0 | 0 | 0 | 0 | 0.19 | 1.98 | 2.98 | 3.75 | 0.62 |
| 15 | 0 | 0.80 | 0 | 0 | 0 | 0 | 0 | 0 | 0.19 | 1.98 | 3.03 | 4.10 | 0.68 |
| 16 | 0 | 0 | 0.20 | 0 | 0 | 0 | 0 | 0 | 0.19 | 1.96 | 3.01 | 4.44 | 0.74 |
| 17 | 0 | 0 | 0.80 | 0 | 0 | 0 | 0 | 0 | 0.20 | 1.96 | 2.96 | 3.94 | 0.65 |
| 18 | 0 | 0 | 0 | 0.20 | 0 | 0 | 0 | 0 | 0.18 | 1.95 | 3.14 | 4.15 | 0.69 |
| 19 | 0 | 0 | 0 | 0.80 | 0 | 0 | 0 | 0 | 0.20 | 1.98 | 3.12 | 4.38 | 0.73 |
| 20 | 0 | 0 | 0 | 0 | 0.20 | 0 | 0 | 0 | 0.20 | 1.97 | 3.00 | 3.84 | 0.64 |
| 21 | 0 | 0 | 0 | 0 | 0.80 | 0 | 0 | 0 | 0.22 | 1.98 | 2.94 | 4.13 | 0.68 |
| 22 | 0 | 0 | 0 | 0 | 0 | 0.20 | 0 | 0 | 0.21 | 1.97 | 3.01 | 3.67 | 0.61 |
| 23 | 0 | 0 | 0 | 0 | 0 | 0.80 | 0 | 0 | 0.21 | 1.96 | 2.91 | 3.67 | 0.61 |
| 24 | 0 | 0 | 0 | 0 | 0 | 0 | 0.20 | 0 | 0.19 | 1.97 | 3.12 | 4.16 | 0.69 |
| 25 | 0 | 0 | 0 | 0 | 0 | 0 | 0.80 | 0 | 0.19 | 1.97 | 3.06 | 3.96 | 0.66 |
| 26 | 0 | 0 | 0 | 0 | 0 | 0 | 0 | 0.20 | 0.22 | 1.97 | 2.98 | 3.95 | 0.65 |
| 27 | 0 | 0 | 0 | 0 | 0 | 0 | 0 | 0.80 | 0.22 | 2.02 | 2.47 | 3.61 | 0.60 |

*6.0 g Ag/m$^2$
A - cyclohexanone oxime (CHOX)
B - 2-methylcyclohexanone oxime
C - 3-methylcyclohexanone oxime
D - 4-methylcyclohexanone oxime
E - acetaldoxime
F - acetone oxime
G - salicylaldoxime
H - acetophenone oxime The data of TABLE III show that saturated cyclic oximes increased the average contrast and the covering power of the silver in the emulsion significantly; however, results with aliphatic or unsaturated cyclic oximes showed poor average contrast and covering power in the resulting coating.

EXAMPLE 4

Emulsions containing three different cyclic oximes were prepared and evaluated in these samples.

TABLE IV

| Sample | PEA | MPT | CHOX | I | J | D-Min | Speed | Av. Contrast | D-max* | Covering Power |
|---|---|---|---|---|---|---|---|---|---|---|
| 28 (control) | 0 | 0 | 0 | 0 | 0 | 0.25 | 2.04 | 3.25 | 3.16 | 0.52 |
| 29 (control) | 25.0 | 0 | 0 | 0 | 0 | 0.20 | 2.06 | 3.11 | 2.85 | 0.47 |
| 30 | 0 | 25.0 | 0.20 | 0 | 0 | 0.16 | 2.10 | 3.36 | 3.41 | 0.56 |
| 31 | 0 | 25.0 | 0.40 | 0 | 0 | 0.16 | 2.11 | 3.47 | 3.69 | 0.61 |
| 32 | 0 | 25.0 | 0.80 | 0 | 0 | 0.15 | 2.11 | 3.54 | 3.87 | 0.64 |
| 33 | 0 | 25.0 | 0 | 0.20 | 0 | 0.16 | 2.09 | 3.18 | 3.38 | 0.56 |
| 34 | 0 | 25.0 | 0 | 0.40 | 0 | 0.15 | 2.09 | 3.44 | 3.47 | 0.57 |
| 35 | 0 | 25.0 | 0 | 0.80 | 0 | 0.15 | 2.09 | 3.44 | 3.45 | 0.57 |
| 36 | 0 | 25.0 | 0 | 0 | 0.20 | 0.15 | 2.08 | 3.42 | 3.24 | 0.54 |
| 37 | 0 | 25.0 | 0 | 0 | 0.40 | 0.16 | 2.11 | 3.41 | 3.37 | 0.56 |
| 38 | 0 | 25.0 | 0 | 0 | 0.80 | 0.15 | 2.10 | 3.35 | 3.04 | 0.50 |

I - cyclopentanone oxime
J - cycloheptanone oxime
* - @ 6.0 g Ag/m$^2$

The data of TABLE IV show that inclusion of a saturated cyclic oxime and MPT in the emulsion gave improved average contrast and covering power compared to the controls.

EXAMPLE 5

Emulsions containing specified amounts of 4-methylcyclohexanone oxime, 2,2-dimethyl-1,3-propanediol, 2-methyl-1,2,3-propanetriol, CHOX, and PEA were compared. The results are in TABLE V.

TABLE V

| Sample | PEA | MPT | CHOX | Compound D** | DMPD | D-Min | Relative Speed | Av. Contrast | D-Max* | Covering Power |
|---|---|---|---|---|---|---|---|---|---|---|
| 39 (control) | 0 | 0 | 0 | 0 | 0 | 0.23 | 2.00 | 3.18 | 3.45 | 0.53 |
| 40 (control) | 25 | 0 | 0 | 0 | 0 | 0.16 | 2.02 | 3.07 | 3.12 | 0.48 |
| 41 | 25 | 0 | 0.80 | 0 | 0 | 0.17 | 2.04 | 3.42 | 3.90 | 0.60 |
| 42 | 0 | 25 | 0.80 | 0 | 0 | 0.15 | 2.08 | 3.60 | 4.09 | 0.63 |
| 43 | 0 | 0 | 0.80 | 0 | 17.0 | 0.17 | 2.06 | 3.52 | 3.96 | 0.61 |
| 44 | 0 | 0 | 0 | 0.20 | 17.0 | 0.17 | 2.02 | 2.95 | 3.70 | 0.57 |
| 45 | 0 | 0 | 0 | 0.40 | 17.0 | 0.17 | 2.04 | 3.30 | 3.83 | 0.59 |
| 46 | 0 | 0 | 0 | 0.80 | 17.0 | 0.18 | 2.08 | 3.60 | 4.29 | 0.66 |

**see footnote to TABLE III
*@ 6.5 g Ag/m$^2$.

Emulsions of TABLE V containing both di- or trimethylolpropane and the specified saturated cyclic oxime exhibited better covering power and better average contrast than the controls.

EXAMPLE 6

Emulsions containing Dextran P® (Pharmachem), CHOX, and PEA were compared in these samples.

TABLE VI

| Sample | PEA | DEXTRAN P® | CHOX | D-Min | Rel. Speed | Av. Contrast | D-Max* | Covering Power | % Increase in Covering Power |
|---|---|---|---|---|---|---|---|---|---|
| 47 (control) | 0 | 0 | 0 | 0.23 | 2.06 | 3.09 | 3.12 | 0.52 | 0 |
| 48 (control) | 12.50 | 0 | 0 | 0.21 | 1.90 | 3.03 | 3.27 | 0.54 | 3.80 |
| 49 (control) | 25.00 | 0 | 0 | 0.17 | 2.05 | 3.01 | 3.11 | 0.51 | −2.00 |
| 50 | 0 | 25.00 | 0 | 0.23 | 2.03 | 3.39 | 3.68 | 0.61 | 7.30 |
| 51 | 12.50 | 25.00 | 0 | 0.22 | 2.04 | 3.20 | 3.79 | 0.63 | 21.10 |
| 52 | 25.00 | 25.00 | 0 | 0.19 | 2.08 | 3.42 | 3.84 | 0.64 | 23.00 |
| 53 | 0 | 0 | 0.80 | 0.35 | 2.02 | 2.32 | 3.81 | 0.63 | 21.10 |
| 54 | 12.50 | 0 | 0.80 | 0.25 | 2.02 | 3.49 | 3.89 | 0.64 | 23.00 |
| 55 | 25.00 | 0 | 0.80 | 0.19 | 2.05 | 3.39 | 3.88 | 0.64 | 23.00 |
| 56 | 0 | 25.00 | 0.80 | 0.24 | 2.05 | 3.60 | 4.39 | 0.72 | 38.40 |
| 57 | 12.50 | 25.00 | 0.80 | 0.22 | 2.06 | 3.65 | 4.37 | 0.72 | 38.40 |
| 58 | 25.00 | 25.00 | 0.80 | 0.19 | 2.10 | 3.55 | 4.45 | 0.74 | 42.30 |

*@ 6.0 g Ag/m$^2$

The data of TABLE VI show that Dextran P®, a gelatin extender, can be used with a saturated cyclic oxime with an additional beneficial effect on the average contrast and covering power achieved.

EXAMPLE 7

Emulsions containing DMPD, Dextran P®, and CHOX were prepared and evaluated in these samples.

TABLE VII

| Sample | DMPD | Dextran P® | CHOX | Dmin | Relative Speed | Ave. Cont. | Dmax* | Covering Power | % Increase Covering Power |
|---|---|---|---|---|---|---|---|---|---|
| 59 | 0 | 0 | 0 | 0.23 | 2.06 | 3.09 | 3.12 | 0.52 | 0 |
| 60 | 8.50 | 0 | 0 | 0.24 | 2.00 | 3.20 | 3.55 | 0.59 | 13.46 |
| 61 | 17.00 | 0 | 0 | 0.19 | 2.04 | 3.59 | 3.60 | 0.60 | 15.30 |
| 62 | 0 | 25.00 | 0 | 0.23 | 2.03 | 3.39 | 3.68 | 0.61 | 17.30 |
| 63 | 8.50 | 25.00 | 0 | 0.20 | 2.03 | 3.26 | 3.49 | 0.58 | 11.50 |
| 64 | 17.00 | 25.00 | 0 | 0.17 | 2.06 | 3.20 | 3.67 | 0.61 | 17.30 |
| 65 | 0 | 0 | 0.80 | 0.35 | 2.02 | 3.32 | 3.81 | 0.63 | 21.10 |
| 66 | 8.50 | 0 | 0.80 | 0.22 | 2.04 | 3.60 | 3.96 | 0.66 | 26.90 |
| 67 | 17.00 | 0 | 0.80 | 0.18 | 2.08 | 3.52 | 3.78 | 0.63 | 21.10 |
| 68 | 0 | 25.00 | 0.80 | 0.24 | 2.05 | 3.60 | 4.39 | 0.72 | 38.40 |
| 69 | 8.50 | 25.00 | 0.80 | 0.21 | 2.06 | 3.33 | 4.04 | 0.67 | 28.80 |
| 70 | 17.00 | 25.00 | 0.80 | 0.18 | 2.03 | 3.87 | 4.34 | 0.72 | 38.40 |

*@ 6.0 g Ag/m$^2$

The data in TABLE VII shows that when DMPD was added to emulsions containing CHOX and Dextran P®, a further increase in average contrast and excellent silver covering power resulted.

EXAMPLE 8

Emulsions containing MPT, Dextran P®, and CHOX were prepared and evaluated in these Examples.

TABLE VIII

| Sample | MPT | Dextran P® | CHOX | Dmin | Relative Speed | Ave. Cont. | Dmax* | Covering Power | % Increase Covering in Power |
|---|---|---|---|---|---|---|---|---|---|
| 71 | 0 | 0 | 0 | 0.23 | 2.06 | 3.09 | 3.12 | 0.52 | 0 |
| 72 | 12.50 | 0 | 0 | 0.22 | 2.03 | 3.46 | 3.41 | 0.56 | 7.60 |
| 73 | 25.00 | 0 | 0 | 0.16 | 2.00 | 3.69 | 3.58 | 0.59 | 13.46 |
| 74 | 0 | 25.00 | 0 | 0.23 | 2.03 | 3.39 | 3.68 | 0.61 | 17.30 |
| 75 | 12.50 | 25.00 | 0 | 0.20 | 2.06 | 3.61 | 3.78 | 0.63 | 21.10 |
| 76 | 25.00 | 25.00 | 0 | 0.16 | 2.07 | 3.63 | 3.73 | 0.62 | 19.20 |
| 77 | 0 | 0 | 0.80 | 0.35 | 2.02 | 3.32 | 3.81 | 0.63 | 21.10 |
| 78 | 12.50 | 0 | 0.80 | 0.22 | 2.06 | 3.29 | 3.94 | 0.65 | 25.00 |
| 79 | 25.00 | 0 | 0.80 | 0.16 | 2.08 | 3.64 | 4.33 | 0.72 | 38.46 |
| 80 | 0 | 25.00 | 0.80 | 0.24 | 2.05 | 3.60 | 4.39 | 0.72 | 38.46 |
| 81 | 12.50 | 25.00 | 0.80 | 0.20 | 2.07 | 3.49 | 4.69 | 0.78 | 50.00 |
| 82 | 25.00 | 25.00 | 0.80 | 0.16 | 2.06 | 3.79 | 4.38 | 0.73 | 40.00 |

*@ 6.0 g Ag/m$^2$

The data of TABLE VIII show that improved average contrast and silver covering power resulted from the addition of MPT to emulsions containing Dextran P® and CHOX.

Various modifications and alterations of this invention will become apparent to those skilled in the art without departing from the scope and spirit of this invention, and it should be understood that this invention is not to be unduly limited to the illustrative embodiments set forth herein.

I claim:

1. A photographic silver halide emulsion comprising a silver halide dispersed in a binder and at least one saturated cyclic oxime compound having the oximido group attached to a ring carbon, said saturated cyclic oxime compound being present in an amount sufficient to increase the covering power and contrast of the developed silver of the silver halide emulsion.

2. The silver halide emulsion of claim 1 wherein said binder comprises gelatin.

3. The silver halide emulsion of claim 2 wherein the cyclic oxime is carbocyclic having up to a total of 14 carbon atoms.

4. The silver halide emulsion according to claim 2 further comprising a di- or trimethylol lower alkane compound.

5. The silver halide emulsion according to claim 1 wherein said saturated cyclic oxime is selected from the class of cyclopentanone oximes, cyclohexanone oximes, and cycloheptanone oximes.

6. The silver halide emulsion according to claim 1 wherein said saturated cyclic oxime compound is selected from cyclohexanone oxime, 2-methylcyclohexanone oxime, 3-methylcyclohexanone oxime, 4-methylcyclohexanone oxime, cyclopentanone oxime, and cycloheptanone oxime.

7. The silver halide emulsion according to claim 1 wherein the quantity of said saturated cyclic oxime compound present is in the range of 0.1 to 2.0 g per mole of silver in said emulsion.

8. The silver halide emulsion according to claim 1 further comprising a di- or trimethylol compound having the formula

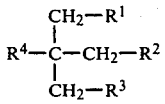

wherein $R_1$, $R_2$, and $R_3$ are H or OH, with the proviso that at least two of $R^1$, $R^2$, and $R^3$ are OH, and $R^4$ is an alkyl group of 1 to 5 carbon atoms.

9. The silver halide emulsion according to claim 8 wherein said di- or trimethylol compound is a lower alkyl 1,1,1-trimethylol or 1,1-dimethylol compound.

10. The silver halide emulsion according to claim 9 wherein said di- or trimethylol lower alkane compound is 1,1,1-trimethylolpropane or 2-methyl-1,2,3-propanetriol.

11. The silver halide emulsion according to claim 8 wherein said di- or trimethylol compound is present in the range of 5 to 50 g per mole of silver in said emulsion.

12. The silver halide emulsion according to claim 2 further comprising photographically effective amounts of materials selected from gelatin extenders, stabilizers, sensitizers, and antifoggants.

13. A silver halide light-sensitive element comprising a support having coated on at least one surface thereon a silver halide containing emulsion, said emulsion having therein at least one saturated cyclic oxime compound having the oximido group attached to a ring carbon, said saturated cyclic oxime compound being present in an amount sufficient to increase the covering power and contrast of the developed silver of the silver halide emulsion.

14. The silver halide light-sensitive element according to claim 13 further comprising a di- or trimethylol lower alkane compound having the formula

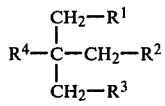

wherein $R^1$, $R^2$, and $R^3$ are selected from H and OH, with the proviso that at least two of $R^1$, $R^2$, and $R^3$ are OH, and $R^4$ is an alkyl group of 1 to 5 carbon atoms.

15. The silver halide light-sensitive element according to claim 13 wherein said element is a radiographic film.

* * * * *